US012427388B2

(12) United States Patent
Anderson et al.

(10) Patent No.: US 12,427,388 B2
(45) Date of Patent: Sep. 30, 2025

(54) RING TOSS GAME APPARATUS

(71) Applicants: John Randolph Anderson, Morehead City, NC (US); Jonathan David Anderson, Raleigh, NC (US)

(72) Inventors: John Randolph Anderson, Morehead City, NC (US); Jonathan David Anderson, Raleigh, NC (US)

( * ) Notice: Subject to any disclaimer, the term of this patent is extended or adjusted under 35 U.S.C. 154(b) by 810 days.

(21) Appl. No.: 17/744,638

(22) Filed: May 14, 2022

(65) Prior Publication Data

US 2023/0364481 A1 Nov. 16, 2023

(51) Int. Cl.
*A63B 67/06* (2006.01)
*A63B 67/10* (2006.01)

(52) U.S. Cl.
CPC ..... *A63B 67/06* (2013.01); *A63B 67/10* (2013.01); *A63B 2067/063* (2013.01)

(58) Field of Classification Search
CPC .... A63B 67/06; A63B 67/10; A63B 2067/063
See application file for complete search history.

(56) References Cited

U.S. PATENT DOCUMENTS 1,052,907 A 2/1913 Ferguson
1,578,142 A 3/1926 Laakowski
3,024,025 A * 3/1962 Richardson ..... A63F 9/02 273/377
3,520,535 A * 7/1970 Mcglade ..... A63F 9/02 273/332
4,564,200 A * 1/1986 Loring ..... A63F 9/0243 273/332
4,635,942 A * 1/1987 Flaherty, Jr. ..... A63B 67/10 273/338
4,863,045 A 9/1989 Altherr
5,171,019 A * 12/1992 Arnette ..... A63F 9/02 273/332
5,709,604 A 1/1998 Coats et al.
7,641,199 B1 * 1/2010 Clarke ..... A63B 67/10 273/330
7,896,349 B2 * 3/2011 Pershin ..... A63F 9/0208 273/332
8,011,664 B2 * 9/2011 Hilbert, Jr. ..... A63B 67/06 273/331

(Continued)

FOREIGN PATENT DOCUMENTS

EP 1502628 A1 * 2/2005 ..... A63F 9/0208

*Primary Examiner* — Raleigh W Chiu
(74) *Attorney, Agent, or Firm* — Mark Taylor

(57) ABSTRACT

A ring toss game apparatus including a ring; a line suspending the ring from a support for manually induced movement of the ring; a housing for mounted disposition a predetermined length away from the ring; a hook mounted to the housing for ring capture through the hook opening; means for providing a control signal responsive to the hook operatively capturing the ring; and means for engaging the ring and moving the ring off the hook wherein games may be played by urging the ring toward the hook with the objective of each iteration being operative engagement of the ring with the hook, resulting in operation of the means for engaging the ring and moving the ring off the hook, thereby allowing another attempt at hook engagement without the player having to approach the hook and manually remove the ring.

20 Claims, 11 Drawing Sheets

(56) References Cited

U.S. PATENT DOCUMENTS

| | | | | |
|---|---|---|---|---|
| 2008/0015058 | A1* | 1/2008 | Noble | A63B 63/007 473/423 |
| 2009/0206550 | A1* | 8/2009 | Pershin | A63F 9/0208 273/332 |
| 2014/0049007 | A1* | 2/2014 | McGetrick | A63F 9/0208 273/332 |
| 2015/0115530 | A1* | 4/2015 | Vanston | A63B 67/06 273/332 |
| 2016/0339333 | A1 | 11/2016 | McGetrick | |
| 2021/0031084 | A1* | 2/2021 | Meister | A63B 67/06 |
| 2022/0080276 | A1* | 3/2022 | Doty | A63B 67/06 |
| 2022/0168629 | A1* | 6/2022 | Stack | A63F 9/0208 |
| 2022/0288477 | A1* | 9/2022 | Payne | A63B 71/0669 |
| 2023/0126962 | A1* | 4/2023 | Christoph | A63B 67/06 273/332 |
| 2023/0364481 | A1* | 11/2023 | Anderson | A63B 67/10 |

* cited by examiner

RING TOSS GAME APPARATUS

BACKGROUND OF THE INVENTION

The present invention relates broadly to apparatus for playing games of skill and more specifically to a ring toss game apparatus wherein a ring, tethered for pendulous movement, is manually guided toward a wall-mounted hook for capture by the hook, if tossed correctly.

Ring toss games are known generally and are employed to provide amusement, and competition or both, whether in someone's home or in a tavern or other public facility. Ring toss games exist with free rings that, as a game, resemble horseshoes and are likewise considered outdoor activities. In order to move the game indoors, the ring is tethered to a line that hangs freely from an overhead support, whether a cantilevered beam, the overhead or other support structure spaced a distance from the receiving hook. The object of such a game is to swing the ring through a pendulous arc toward a properly sized hook for capture of the ring on the hook. Scoring is accomplished by successfully placing the ring on the hook for retention thereby.

One such game apparatus is disclosed in Ferguson, U.S. Pat. No. 1,052,907. There, with reference to FIG. 5, a ring 24 is tethered from a support beam 22, using a line 23. A user or player will urge the ring toward a hook, such that the ring swings in a pendulous manner through an arc toward a hook, or series of hooks, as seen in Ferguson '907 for capture thereby. As may be appreciated, the ability to successfully place the ring on the hook takes a certain amount of practice and skill.

A problem associated with the Ferguson '907 apparatus is that a player has to approach the hook and manually remove the ring from the hook for another attempt at ring capture. Further, scoring is also manually accomplished beyond a single-capture event. Ferguson '907 teaches multiple hooks, each with a predetermined score, which must be manually tallied, if at all.

In order to speed up the game, others have developed apparatus and methods to free the ring from the hook once captured, so that game play may be continued substantially uninterrupted. Such a structure is disclosed in Laskowski, U.S. Pat. No. 1,578,142. As seen in FIG. 1, Laskowski '142, discloses a fairly complex apparatus to allow the hook to selectively release the ring.

A further development was provided by Coats et. al, U.S. Pat. No. 5,709,604. There, a stationary hook, as seen in FIG. 1, is caused to rotate in a manner so as to invert the hook, thereby allowing the ring to drop free of the hook and swing back toward a user under the influence of gravity. Both the Laskowski '142 and the Coats '604 structures are gravity-based systems that require the hook to move during a ring removal event.

There accordingly exists a need for an apparatus to remove a ring from a hook in a ring toss game, in a manner that results in the ring being returned to the user quickly with the hook remaining stationary, ready to receive and capture the ring once again.

When playing ring toss games, each capture of the ring by a hook results in a scoring event that should be tallied. Such scoring systems range from the obvious, as seen by the multiple hooks with different scores written above the hooks at Ferguson '907, to the more sophisticated and modern. For example, Coats '604 has elevated scoring to an electronic endeavor and provides a displayed numerical score, updated on an ongoing basis throughout game-play. One of the problems with such electronic scoring systems is that it can be difficult to know whether an actual capture event has occurred or if the ring has merely made contact with a hook, such that no actual capture occurs. Coats '604 is silent on the structure required to determine whether an actual capture event has occurred in order to correctly tally the score.

Accordingly, a problem exists with electronic scoring systems for ring toss games, in that it is difficult to determine when an actual capture event has occurred or whether a mere ring-hook collision has occurred.

Another problem with such electronic scoring systems is that the unscrupulous player could merely stand in front of hook and repeat capture events one immediately after the other, thereby tallying scores in an unfair manner. Accordingly, there exists a need to ensure that the ring has been tossed from the designated starting line in order to enhance the control of game-play.

Therefore, while a tethered ring toss game can be an exciting and enjoyable competitive experience, such experience can be enhanced if the above-identified problems are addressed and solved.

SUMMARY OF THE INVENTION

It is accordingly an object of the present invention to provide a ring toss game apparatus that will further enhance the pace of a ring toss game by surely and rapidly engaging and removing a ring from the hook.

It is another object of the present invention to provide a ring toss game apparatus with enhanced automated scoring accuracy.

It is another object of the present invention to provide such a ring toss game apparatus that deters unscrupulous game play.

To those collective ends, and according to one preferred embodiment thereof, the present invention is directed to a ring toss game apparatus including a generally toroidal ring and a line configured for suspending the ring from a support structure at a distal end of the line, for selective, manually induced pendulous movement of the ring through an arcuate path. Also included is a housing configured for mounted disposition a predetermined length away from the ring support structure and a hook mounted to the housing for operative capture of the ring through the hook opening.

In addition, the present invention includes a device for providing a control signal responsive to the hook operatively capturing the ring and an apparatus for engaging the ring and moving the ring off the hook in operational communication with the device for providing a control signal, the apparatus for engaging the ring and moving the ring off the hook being operable responsive to the control signal to engage the ring and move the ring off the hook.

Accordingly, games may be played by manually inducing pendulous movement of the ring toward the hook with the objective of each iteration thereof being operative engagement of the ring with the hook, resulting in a control signal being generated and applied to the apparatus for engaging the ring and moving the ring off the hook, to engage the ring and move the ring off the hook, thereby allowing the ring to move under gravity and swing back to a player, thereby allowing another attempt at hook engagement without the player having to approach the hook and manually remove the ring.

It is preferred that the device for providing a control signal includes an electrical circuit having a normally-open switch operatively associated with the hook, wherein the switch is closed upon operative capture of the ring by the hook, the control circuit being in operative communication with the apparatus for engaging the ring and moving the ring off the hook, wherein closing the switch initiates the control signal, thereby activating the apparatus for engaging the ring and moving the ring off the hook.

It is further preferred that the hook includes a first conductive element, a second conductive element, and an insulator therebetween extending a predetermined distance through the long axis of the hook, thereby defining two conductors separated by an insulator through the length of the hook, wherein the first conductive element and the second conductive element are operatively connected to the device for providing a control signal, and wherein the ring is formed from an electrically conductive material, whereby the hook and the ring form the normally-open switch which is closed by operative capture of the ring by the hook, thereby causing the ring to electrically connect the first conductive element and the second conductive element, thereby closing the switch and initiating the control signal, thereby activating the apparatus for engaging the ring and moving the ring off the hook.

Preferably, the device for providing a control signal includes an electrical circuit having an optical switch operatively associated with the hook, wherein the switch is closed upon operative capture of the ring by the hook, the control circuit being in operative communication with the apparatus for engaging the ring and moving the ring off the hook, wherein closing the switch initiates the control signal, thereby activating the apparatus for engaging the ring and moving the ring off the hook.

It is further preferred that the device for providing a control signal includes an electrical circuit having the hook in the circuit as a resistive element with a first predetermined resistance, wherein the operative capture of the hook results in the hook and ring forming the resistive element with a second predetermined resistance, and a voltage detector to detect the change in voltage drop across the resistive element caused by operative capture of the ring by the hook, the control circuit being in operative communication with the apparatus for engaging the ring and moving the ring off the hook, wherein change in voltage drop across the resistive element activates the apparatus for engaging the ring and moving the ring off the hook.

Preferentially, both the ring and hook are in electrical communication the control circuit, wherein the hook and ring form a switch that is closed upon operative capture of the ring by the hook, the control circuit being in operative communication with the apparatus for engaging the ring and moving the ring off the hook, wherein closing the switch initiates the control signal, thereby activating the apparatus for engaging the ring and moving the ring off the hook.

Preferably, the apparatus for engaging the ring and moving the ring off the hook includes a movable arm mounted to the housing adjacent the hook for ring-removal movement through a predetermined path to selectively engage the ring and move the ring off the hook.

It is additionally preferred that the apparatus for engaging the ring and moving the ring off the hook includes a motor operatively associated with the arm for driving the arm through the predetermined path to selectively engage the ring and move the ring off the hook, and a motor control circuit for controlling motor operation. Preferably, the motor is a servo motor configured to drive the arm between a vertically downwardly extending disposition and a generally upwardly extending position along the predetermined path upon activation by the motor control circuit signal to selectively engage the ring and move the ring off the hook.

It is also preferred that the device for providing a control signal includes a time delay circuit in operative communication with the motor control circuit to delay activation of the apparatus for engaging the ring and moving the ring off the hook for a predetermined duration after the ring contacts the hook, thereby establishing an operative capture of the ring. It is preferred that the device for providing a control signal includes a time delay circuit configured to delay application of the control signal for a predetermined time after each operative ring capture to allow the ring to swing back to a user.

The present invention further preferably includes a scoring circuit including a preprogrammed microcomputer having at least one counter circuit configured to count the number of operative ring captures, and a display element operatively associated with the counter element to display a numerical score.

Preferably, the present invention further includes an elapsed time calculator selectively operable in association with the control circuit for timed game activities and a display element mounted to the housing for displaying numerical time data.

According to another preferred embodiment of the present invention, a ring toss game apparatus includes a generally toroidal ring, a line configured for suspending the ring from a support structure at a distal end of the line, for selective, manually induced pendulous movement of the ring through an arcuate path and a housing configured for mounted disposition a predetermined length away from the ring support structure. A hook is mounted to the housing for operative capture of the ring through the hook opening.

Also included is a device for providing a control signal responsive to the hook operatively capturing the ring including an electrical circuit having a switch operatively associated with the hook, wherein the switch is closed upon operative capture of the ring by the hook. The present invention also includes an apparatus for engaging the ring and moving the ring off the hook in operational communication with the device for providing a control signal, the apparatus for engaging the ring and moving the ring off the hook being operable responsive to the control signal to engage the ring and move the ring off the hook.

Thereby, games may be played by manually inducing pendulous movement of the ring toward the hook with the objective of each iteration thereof being operative engagement of the ring with the hook, resulting in a control signal being generated and applied to the apparatus for engaging the ring and moving the ring off the hook, to engage the ring and move the ring off the hook, thereby allowing the ring to move under gravity and swing back to a player, thereby allowing another attempt at hook engagement without the player having to approach the hook and manually remove the ring.

It is preferred that the hook includes a first conductive element, a second conductive element, and an insulator therebetween extending a predetermined distance through the long axis of the hook, thereby defining two conductors separated by an insulator through the length of the hook, wherein the first conductive element and the second conductive element are operatively connected to the device for providing a control signal, and wherein the ring is formed from an electrically conductive material, whereby the hook and the ring form the normally-open switch which is closed by operative capture of the ring by the hook, thereby causing the ring to electrically connect the first conductive element and the second conductive element, thereby closing the switch and initiating the control signal.

Preferably, the device for providing a control signal includes an electrical circuit having an optical switch operatively associated with the hook, wherein the switch is closed upon operative capture of the ring by the hook, the control circuit being in operative communication with the means for engaging the ring and moving the ring off the hook, wherein closing the switch activates the means for engaging the ring and moving the ring off the hook.

It is further preferred that the device for providing a control signal includes an electrical circuit having the hook in the circuit as a resistive element with a first predetermined resistance, wherein the operative capture of the hook results in the hook and ring forming the resistive element with a second predetermined resistance, and a voltage detector to detect the change in voltage drop across the resistive element caused by operative capture of the ring by the hook, the control circuit being in operative communication with the means for engaging the ring and moving the ring off the hook, wherein change in voltage drop across the resistive element acts as the switch to activate the apparatus for engaging the ring and moving the ring off the hook.

Preferentially, wherein both the ring and hook are in electrical communication the control circuit, wherein the hook and ring form a switch that is closed upon operative capture of the ring by the hook, the control circuit being in operative communication with the apparatus for engaging the ring and moving the ring off the hook, wherein closing the switch activates the means for engaging the ring and moving the ring off the hook.

It is further preferred that the apparatus for engaging the ring and moving the ring off the hook includes a movable arm mounted to the housing adjacent the hook for ring-removal movement through a predetermined path to selectively engage the ring and move the ring off the hook, a servo motor operatively associated with the arm for driving the arm through the predetermined path to selectively engage the ring and move the ring off the hook, and a motor control circuit for controlling motor operation.

According to another preferred embodiment of the present invention, a toss game apparatus includes a generally toroidal ring, a line configured for suspending the ring from a support structure at a distal end of the line, for selective, manually induced pendulous movement of the ring through an arcuate path, and a housing configured for mounted disposition a predetermined length away from the ring support structure. A hook is mounted to the housing for operative capture of the ring through the hook opening.

The present invention also includes a device for providing a control signal responsive to the hook operatively capturing the ring including an electrical circuit having a switch operatively associated with the hook, wherein the switch is closed upon operative capture of the ring by the hook.

The present invention further includes an apparatus for engaging the ring and moving the ring off the hook in operational communication with the device for providing a control signal, the apparatus for engaging the ring and moving the ring off the hook being operable responsive to the control signal to engage the ring and move the ring off the hook and including a movable arm mounted to the housing adjacent the hook for ring-removal movement through a predetermined path to selectively engage the ring and move the ring off the hook, a motor operatively associated with the arm for driving the arm through the predetermined path to selectively engage the ring and move the ring off the hook and a motor control circuit for controlling motor operation responsive to the device for providing a control signal.

Thereby, games may be played by manually inducing pendulous movement of the ring toward the hook with the objective of each iteration thereof being operative engagement of the ring with the hook, resulting in a control signal being generated and applied to the apparatus for engaging the ring and moving the ring off the hook, to engage the ring and move the ring off the hook, thereby allowing the ring to move under gravity and swing back to a player, thereby allowing another attempt at hook engagement without the player having to approach the hook and manually remove the ring.

It is preferred that the control circuit being in operative communication with the apparatus for engaging the ring and moving the ring off the hook, wherein closing the switch activates the apparatus for engaging the ring and moving the ring off the hook.

By the above, the present invention provides a ring toss game apparatus that will further enhance the pace of a ring toss game by surely and rapidly engaging in removing a ring from the hook. In addition, the present invention provides a ring toss game apparatus with enhanced automated scoring accuracy. Further, the present invention provides a ring toss game apparatus that deters unscrupulous game play.

DESCRIPTION OF THE PREFERRED EMBODIMENT

Figure 1A:
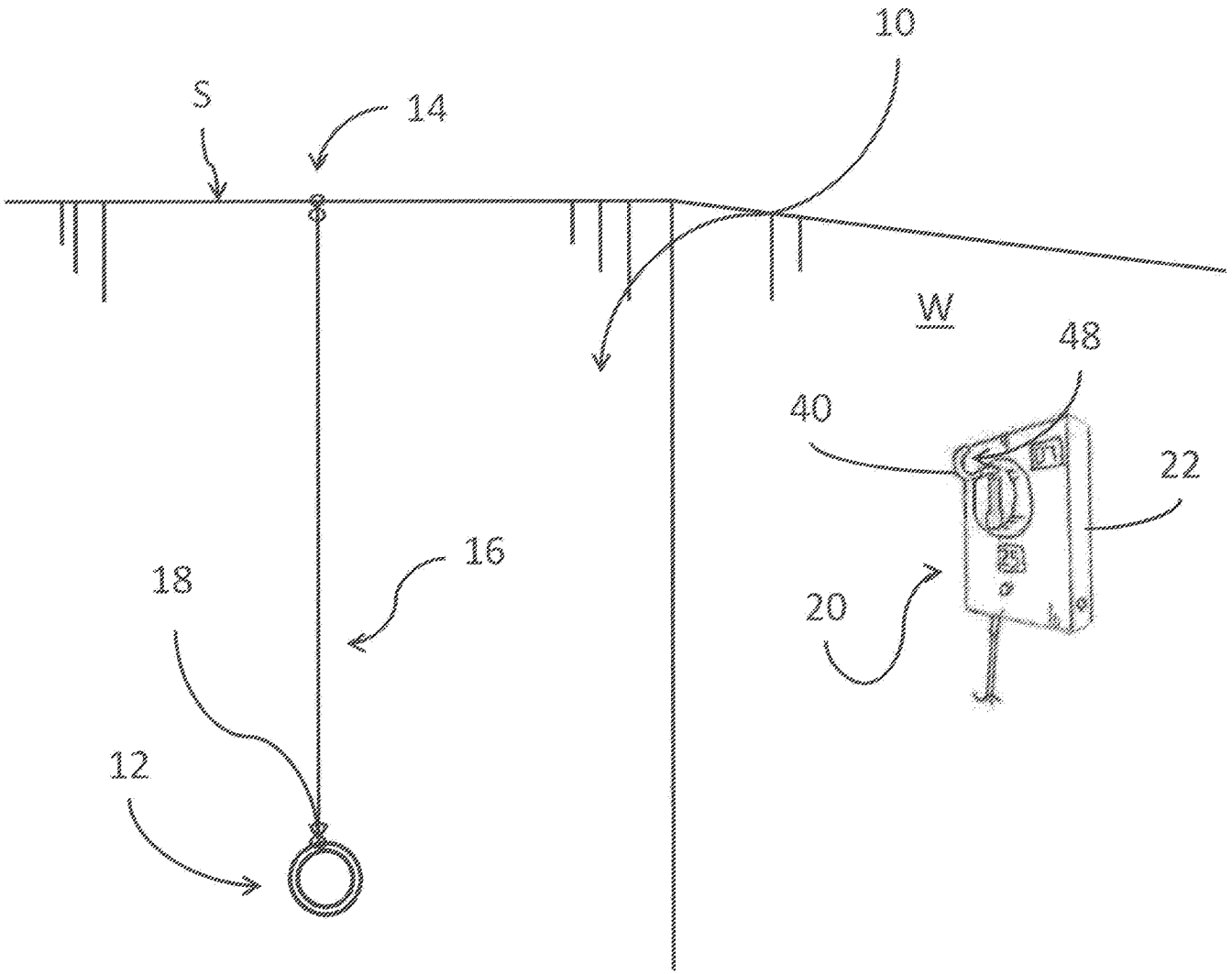
FIGS. 1A and 1B are sequential environmental views of a ring toss game illustrating basic game-play according to one preferred embodiment of the present invention.

Turning now to the drawings and more particularly to FIG. 1, a ring toss game apparatus according to the preferred embodiment of the present invention is illustrated generally at 10, and includes a ring 12 formed preferably from an electrically conductive metal, as a thin toroid. The ring 12 is attached to a line 16 which is suspended from a support surface S as such as a ceiling or cantilever beam at a mount 14. The line 16 may be any suitable cotton, nylon, hemp, monofilament or other pliant cord. The line 16 is attached to both the mount 14 and the ring 12 using swivel connectors 18 that provide independent 360° relative motion of the line 16 with respect to the mount 14 and of the ring 12 with respect to line 16. Accordingly, the ring 12 is configured for selective pendulous movement under the influence of gravity.

Figure 1B:
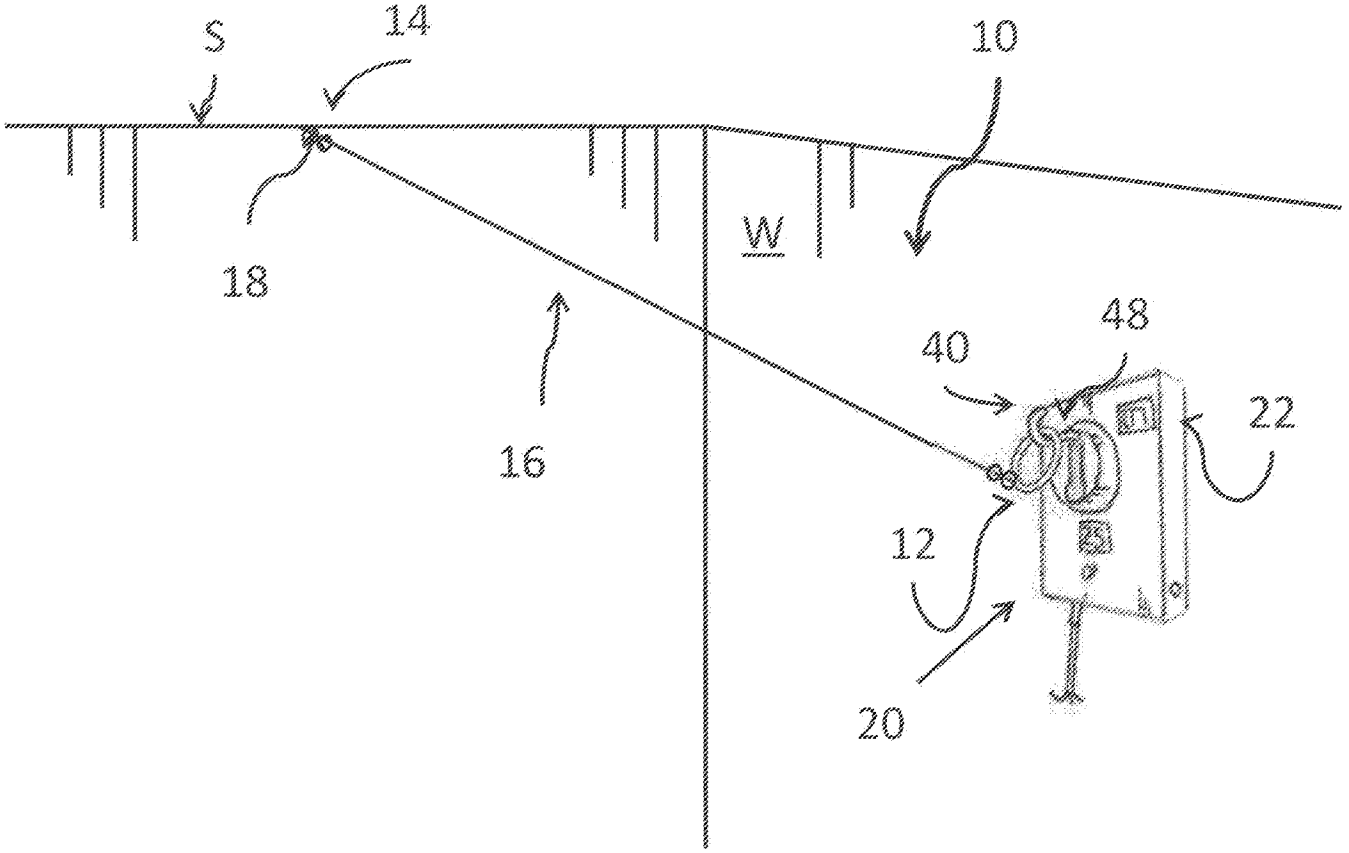

A receiver 20 is mounted to a wall W or other generally vertical surface a predetermined distance away from the ring mount 14. The receiver 20 includes a housing 22 with a hook 40 projecting laterally outwardly therefrom toward the ring 12, and in general alignment therewith. As noted above, the hook 40 must be mounted a predetermined distance away from the ring mount 14, and therefore the 12, for proper game-play. Suspended from an eight-foot ceiling, a four-foot line 16 suspends the ring 12 in an operable position for player use. If the line is four feet long, presuming an angle of incidence of about 60° at capture, the receiver 20 should be mounted approximately six feet from the floor with the ring mount 14 approximately three and a half feet back from the hook 40. This should give the line 16 sufficient slack to allow the ring 12 to collide with the hook, with the ring 12 passing thorough the hook opening 48, resulting in capture of the ring 12 as seen in FIG. 1B.

During game play, a player (not shown) engages the ring 12 and manually urges or swings the ring 12 in a pendulous motion along an arc toward the hook. If the player is of sufficient skill, luck, and aim, an operative capture will occur wherein the ring 12 goes through the hook opening 48 and is captured by the hook 40 as seen in FIG. 1B. As will be seen, an operative capture occurs when the ring 12 and hook 40 remain in contact for a predetermined time period. Further details of game-play with the present invention will be discussed in greater detail hereinafter, once the features of the present invention have been more fully explained.

Figure 2:
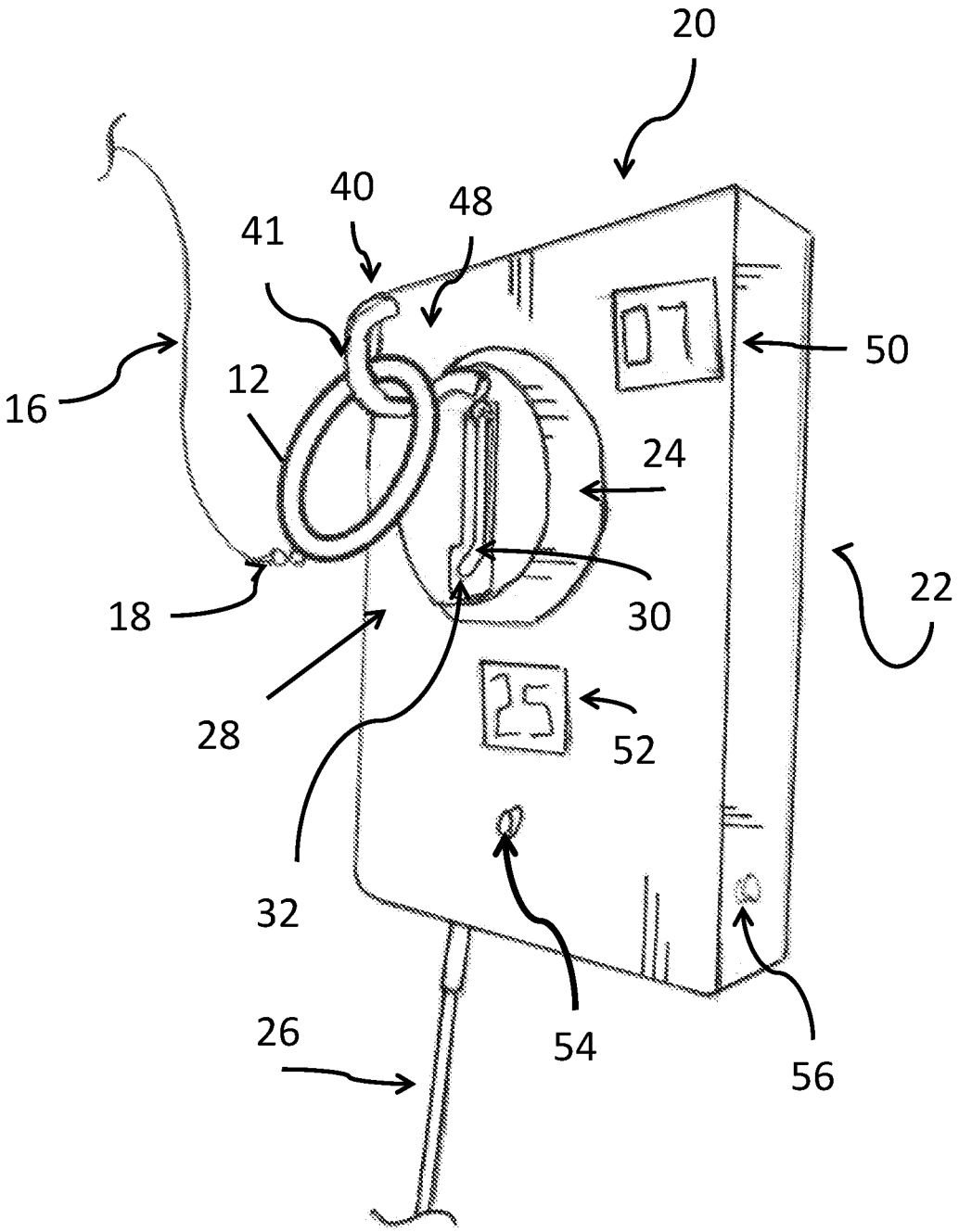
FIG. 2 is a perspective view of a receiver according to one preferred embodiment of the present invention.

With reference to FIG. 2, the receiver 20 is illustrated in greater detail and includes the aforesaid housing 22, which is formed as a generally rectangular box, longer and wider than it is deep. Typical dimensions for housing are approximately 10.0×7.0×1.5 inches. One function of the housing 22 is to provide a compartment for the control electronics, as will be explained in greater detail hereinafter, and a display surface for scoring and time information as will also be explained in greater detail hereinafter. The housing 22 also provides a mounting structure for the hook 40. To that end, a sub-housing 24 projects outwardly from the housing 22 on the front face thereof. The sub-housing 24 acts as the cavity for mounting the apparatus for engaging the ring and removing the ring from the hook, or ring removal apparatus 28, and is formed with an opening 32 therein to facilitate operation of the ring removal apparatus 28. Further, the sub-housing 24 acts to space the hook away from the housing 22, thereby reducing the potential for the ring 12 colliding with the housing 22.

The hook 40 is formed with a substantially metallic shank 41 and is mounted to the sub-housing 24 to project laterally outwardly therefrom. The shank 41 extends a predetermined distance away from the sub-housing 24 and curves in the manner of a typical hook to form a partial loop with the distal end extending back toward the housing 22. The distal end of the shank 41 is angled approximately 50° from the vertical toward the housing 22 and defines a hook opening 48 through which the ring 12 can pass. As will be seen in greater detail hereinafter, the hook 40 can play an integral role in electrically determining whether an operative capture of the ring 12 has occurred.

The housing 22 also provides a structure for game controls that may include a game selector switch 54 and a power switch 56. In addition, other switches such as a time reset switch (72 in FIGS. 5-8) may also be included. The housing 22 also provides a space on the front face thereof for an electronic elapsed time display 52 and an electronic score display 50. It will be understood by those skilled in the art that housing structure 22 is not limited to the foregoing switches and displays and that many arrangements of switches and displays may be employed without departing from the spirit and the scope of the present invention.

The housing 22 also provides a cavity for a power supply which may be associated with a typical wall plug (not shown) and wire arrangement 26 as is known in the electrical arts. Further, receiver 20 may be battery powered using dry cells (not shown) for a more portable ring toss game apparatus 10.

As stated above, the sub-housing 24 contains the ring removal apparatus 28. There, a servo motor (36 in FIGS. 5-8), which may be an off-the-shelf RC hobby item, is mounted within the sub-housing 24 and, as will be explained hereinafter, is in electrical communication with the control electronics. An arm 30 is operatively mounted thereto adjacent the hook 40 for motor-driven rotational travel along a predetermined path between a stowed condition extending vertically downwardly within the sub-housing, and a fully extended position adjacent the hook opening 48. The arm 30 includes a distal end that is angled away from the long axis of the arm 30 to engage the ring 12. The arm 30 is disposed within the sub-housing 24 which is formed with a slot 32 through which the arm 30 emerges for ring 12 removal. As will be explained in greater detail hereinafter, upon operative capture of the ring 12, the servo motor is energized driving the arm 30 into operation.

Figure 3A:
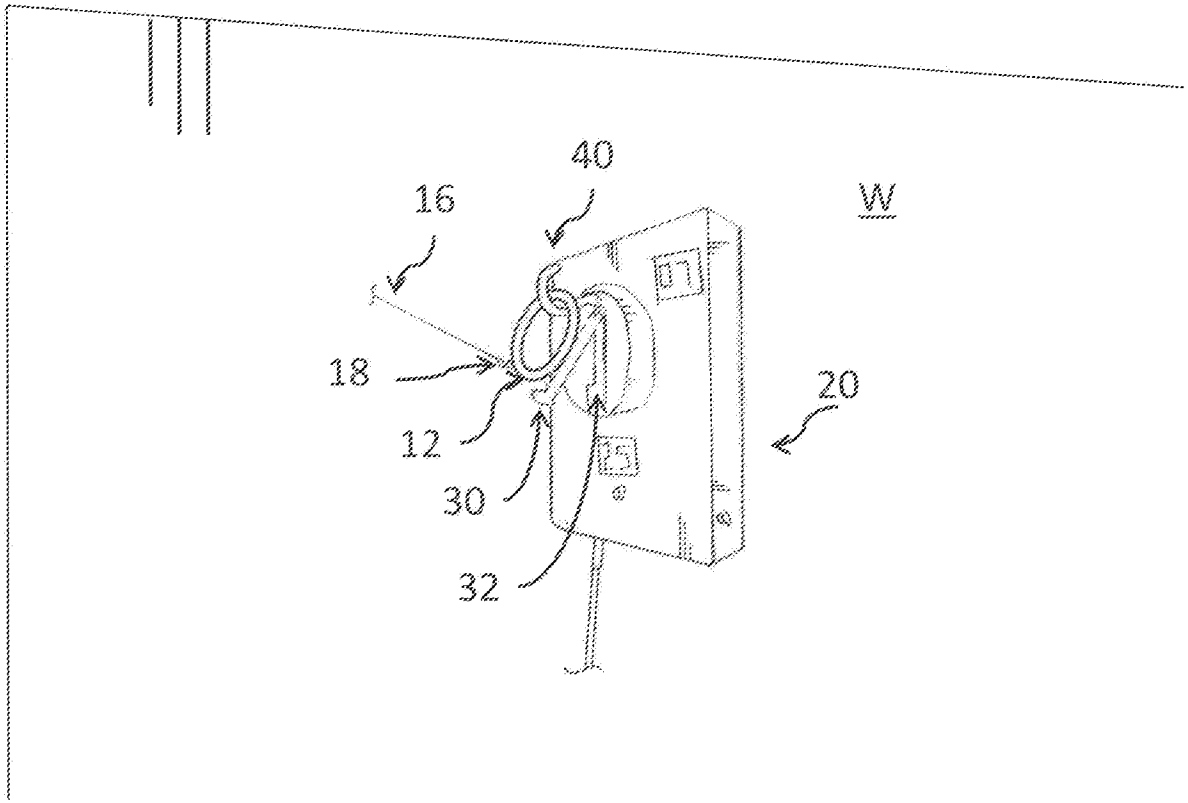
FIGS. 3A, 3B and 3C are sequential perspective views of the apparatus for engaging the ring and removing the ring in operation.
Figure 3B:
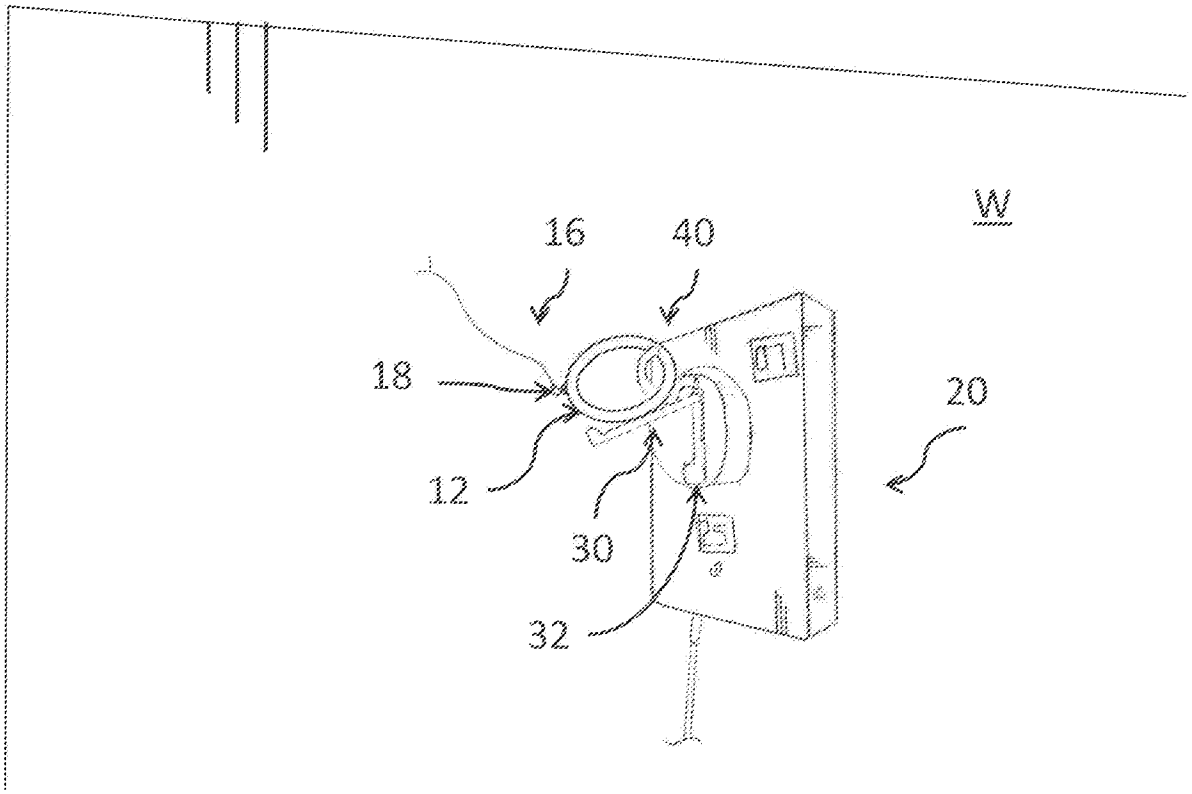
Figure 3C:
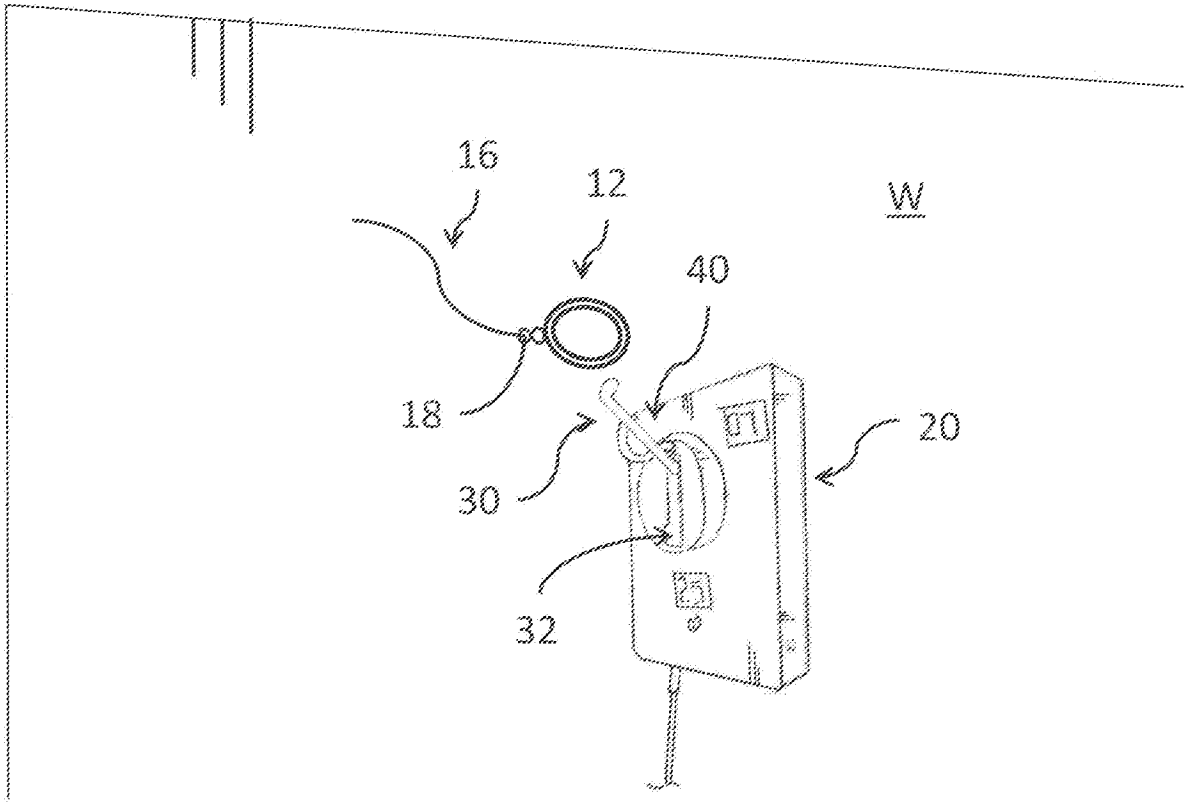

Turning now to FIGS. 3A, 3B, and 3C, the ring removal operation by the ring removal apparatus 28 is illustrated. In FIG. 3A, operative capture has been established, a control signal generated and the apparatus for ring removal energized. The control signal originates with the operative capture of the ring by the hook as will be discussed hereinafter. The arm 30 is seen in FIG. 3A after having exited the sub-housing 24 through the slot 32 along its predetermined path and is about to engage the ring 12. In FIG. 3B, the arm 30 has engaged the ring 12 and continues upwardly through its predetermined path, driving the ring 12 upwardly and away from the bottom portion of the hook 40 toward the hook opening 48. FIG. 3C illustrates the arm 30 at the end of its path having traveled approximately 143° of rotation and the ring 12 has been thrown free from the hook 40.

The ring removal apparatus 28 enhances game-play, especially automated scoring and timed game-play, since the player no longer has to walk to the receiver 20 to remove the ring 12 from the hook 40. With the present invention, the ring 12 is quickly tossed free from the hook 40 and allowed to swing under the influence of gravity back toward the player, thereby enhancing the pace of the game. Further, a player's skills can be enhanced, because if a "sweet spot" to stand for proper aim is established, the player can remain at that position to await ring return.

While the pace of the game is enhanced by the structure set forth above, control of the game must be maintained especially with respect to scoring. Any game that is electronically scored depends on some electronic input that indicates that a scoring event has occurred. In the present case, the scoring event has occurred when the hook 40 "operatively captures" the ring 12. As used herein, the term "operative capture" means that the hook has captured the ring sufficiently to count as a scoring event and a triggering event for operation of the ring removal apparatus 28.

In order to maintain scoring integrity using the electronic scoring system of the present invention, the present invention includes a device for providing the control signal that acts as a trigger for both scoring and ring removal.

With reference to FIGS. 5-8, overall game control is accomplished by a control circuit 60, which is preferably supported on a printed circuit board (not shown), including at least one preprogrammed microcomputer operating as a game controller 62. FIGS. 5 through 8 illustrate the game control circuit 60 and associated parts in block diagram form. It will be appreciated by those skilled in the art that the necessary circuitry can be assembled and programmed as desired, such that no particular circuit arrangement is required to accomplish each task set forth above.

The device for providing a control signal is illustrated at 58 and includes the hook 40 and a time delay circuit 66. In order to establish an operative capture, the ring 12 must lay on the hook 40 for a predetermined time period, which may be on the order of 0.5 seconds, in order to avoid spurious scoring events, such as when the ring 12 merely collides with the hook 40.

Figure 4:
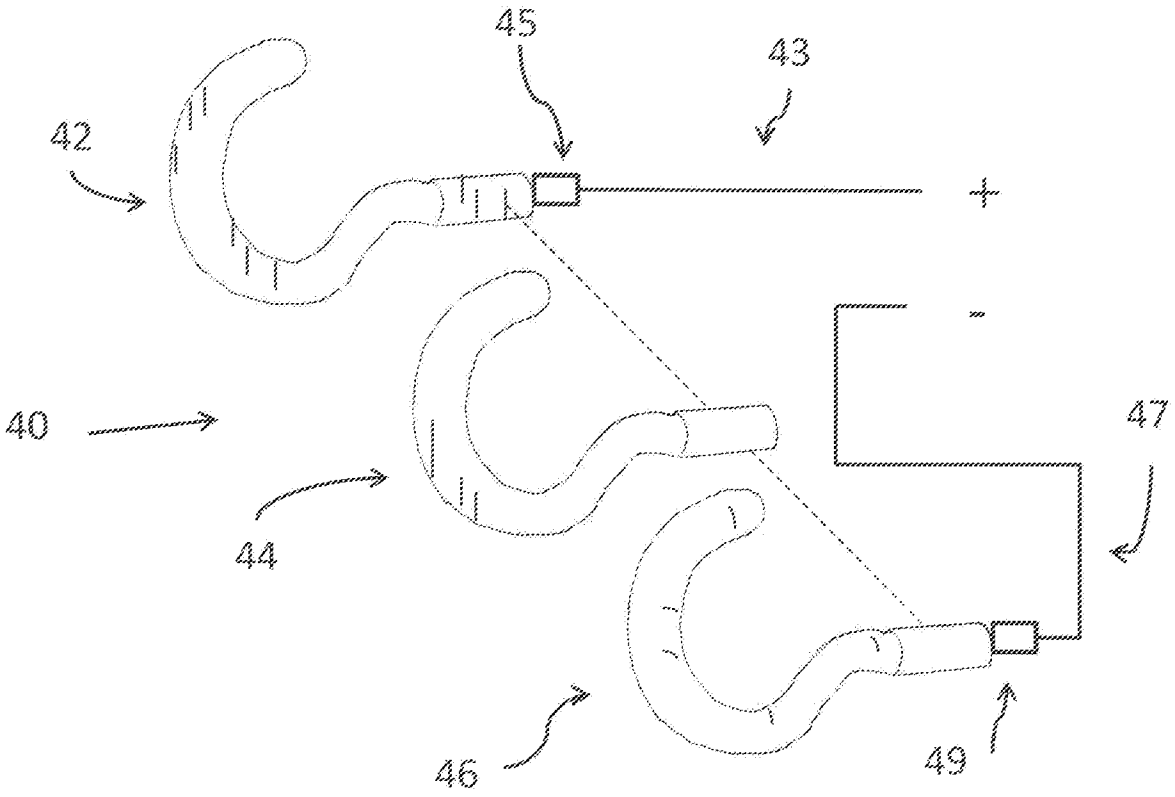
FIG. 4 is an exploded view of a hook according to one preferred embodiment of the present invention.

In a first preferred embodiment of the present invention, and with reference to FIG. 4, the hook is formed in three portions, 42, 44, 46, with outer portions 42, 46 being metallic and, therefore, conductive, while the inner portion 44 is an insulator. The first hook portion 42 is connected to the time delay 66 using conventional wiring 43 and connectors 45. In a similar manner, the third portion of the hook 46 is connected to the time delay 66 with associated wiring 47 and connectors 49. Such an arrangement results in a potential difference across the conductive hook portions 42, 46. When the metallic ring 12 passes through the hook opening 48 and comes to rest on the hook, the conductive ring 12 bridges the insulation gap 44 of the hook, causing current to flow from the first hook portion 42 to the second hook portion 46, thereby providing an operative-capture signal for the time delay circuit 66. If the operative-capture signal is present for the predetermined time delay, a control signal CS is generated and distributed throughout the game control circuit 60 as necessary.

As previously discussed, the ring removal apparatus 28 includes the servo motor 36 with the arm 30 attached thereto. A motor controller 64 is operatively associated with the game control circuit 60 and operates the ring removal apparatus 28 upon receipt of the control signal CS from the first time delay 66. Therefore, once the operative capture is established, the control signal CS is sent to the motor controller 64 from the first time delay 66 and the ring removal apparatus 28 cycles thought its operation to remove the ring 12 from the hook 40.

In order to enhance game integrity, the motor controller 64 is operatively connected to a second time delay circuit 68 which provides a predetermined time delay on the order of 6.0 seconds, upon completion of the ring removal apparatus 28 operation, and sends a signal to the game controller 62 to halt further game-play for the predetermined time period to allow the ring 12 to swing back to the player.

The game controller 62, provides overall control of any number of games for game-play. The game controller 62 is operatively connected to a scoring circuit 70, which provides scoring information for a first score display 50 and a second score display 51. The scoring circuit 70 is controlled by the game controller 62, which withholds a scoring signal until the first time delay circuit 66 provides a control signal CS indicating an operative capture event has occurred and the second time delay circuit 68 communicates that sufficient time has passed since the last ring removal event to allow further scoring. The scoring circuit 70 tallies operative capture events and displays a score on a first score display 50 and, optionally, a second score display 51. There are no particular number of score displays required. Multiple score displays are at the discretion of the game designer.

The control circuit 60 also includes an elapsed timer 72, having an elapsed time display 54 and an elapsed time reset switch 84. The elapsed timer 72 provides a signal to the game controller for use in various game scenarios. Also included are a power switch 80 and a game controller reset switch 82 that can be used to cycle through various game scenarios as programmed into the preprogrammed game controller 62.

Figure 6:
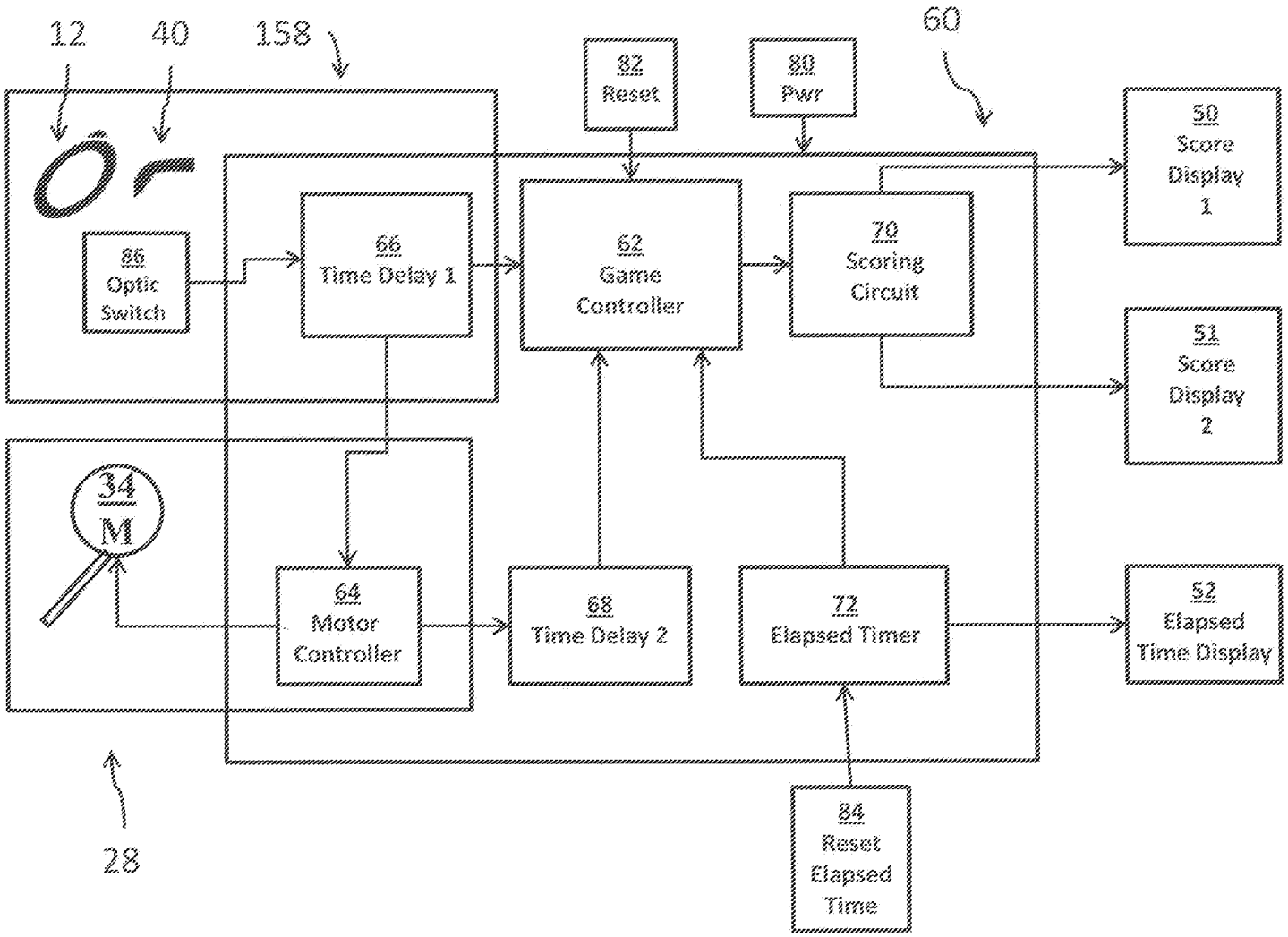
FIG. 6 is a block diagram of an electronic game control system according to another preferred embodiment of the present invention.

With reference now to FIG. 6, a second preferred version of the device for providing a control signal is illustrated at 158 and includes the same first time delay circuit 66 as discussed above. An optical switch 86 is provided on the outer surface of the housing 22 or sub-housing 24 adjacent the hook 12 and is aimed for providing a signal when the ring 12 passes a certain point after passing through the hook opening 48.

Figure 7:
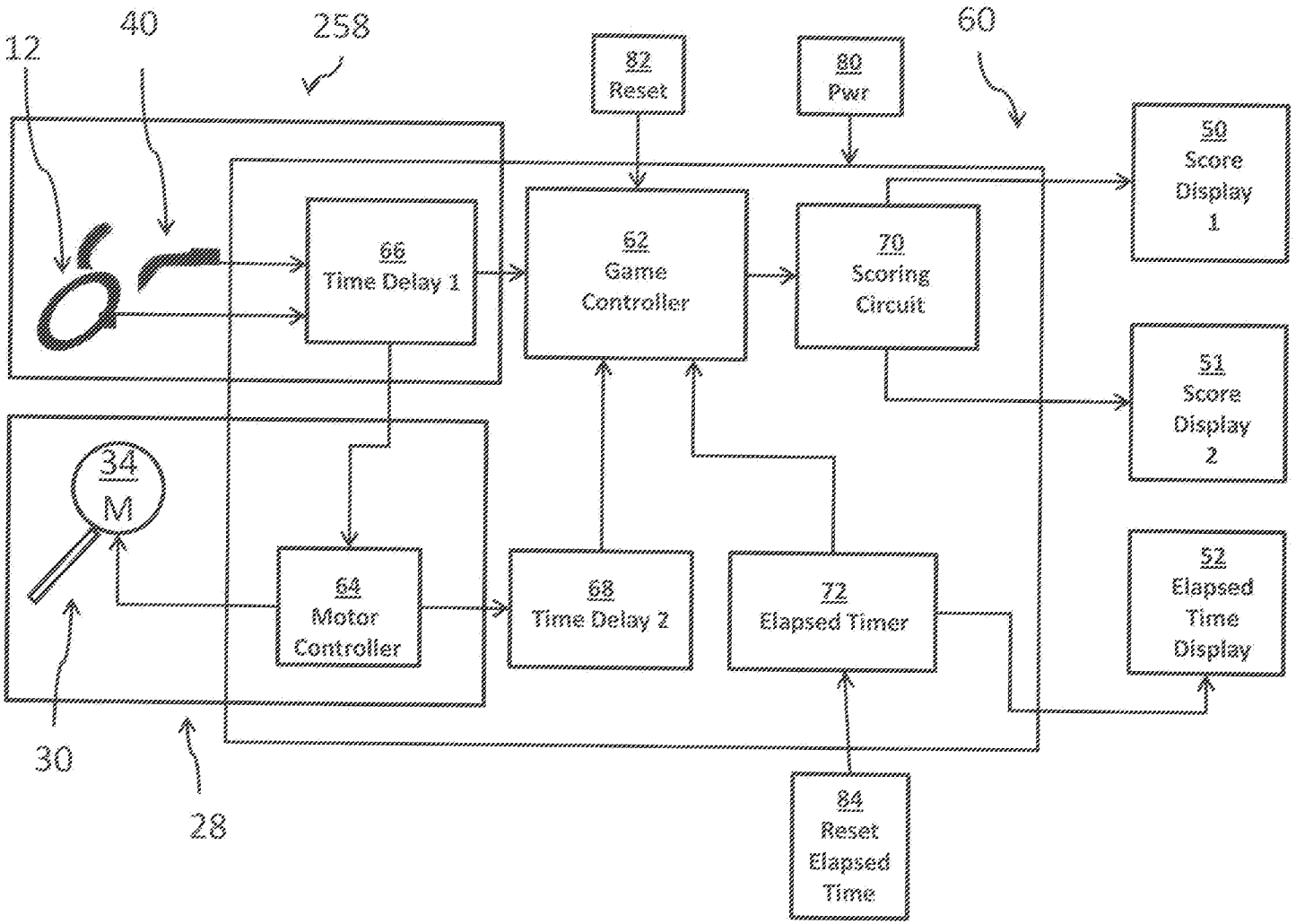
FIG. 7 is a block diagram of an electronic game control system according to another preferred embodiment of the present invention.

Turning now to FIG. 7, a third preferred embodiment of the device while providing a control signal is illustrated at 258 and in this situation both the ring 12 and the hook 40 are individually wired such that an ungrounded voltage exists on the ring 12 and the hook 40. It should be noted that such an arrangement provides a low voltage DC potential on both the ring 12 and the hook 40 and does not provide a shock hazard. According to the third preferred embodiment, once the ring 12 lands on the hook 40, a circuit is completed such that current may flow between the ring 12 and the hook 40. The ring 12 and hook 40 are both operatively associated with the first time delay 66 such that a control signal CS is generated once the ring 12 and the hook 40 are in contact for the predetermined time period.

Figure 8:
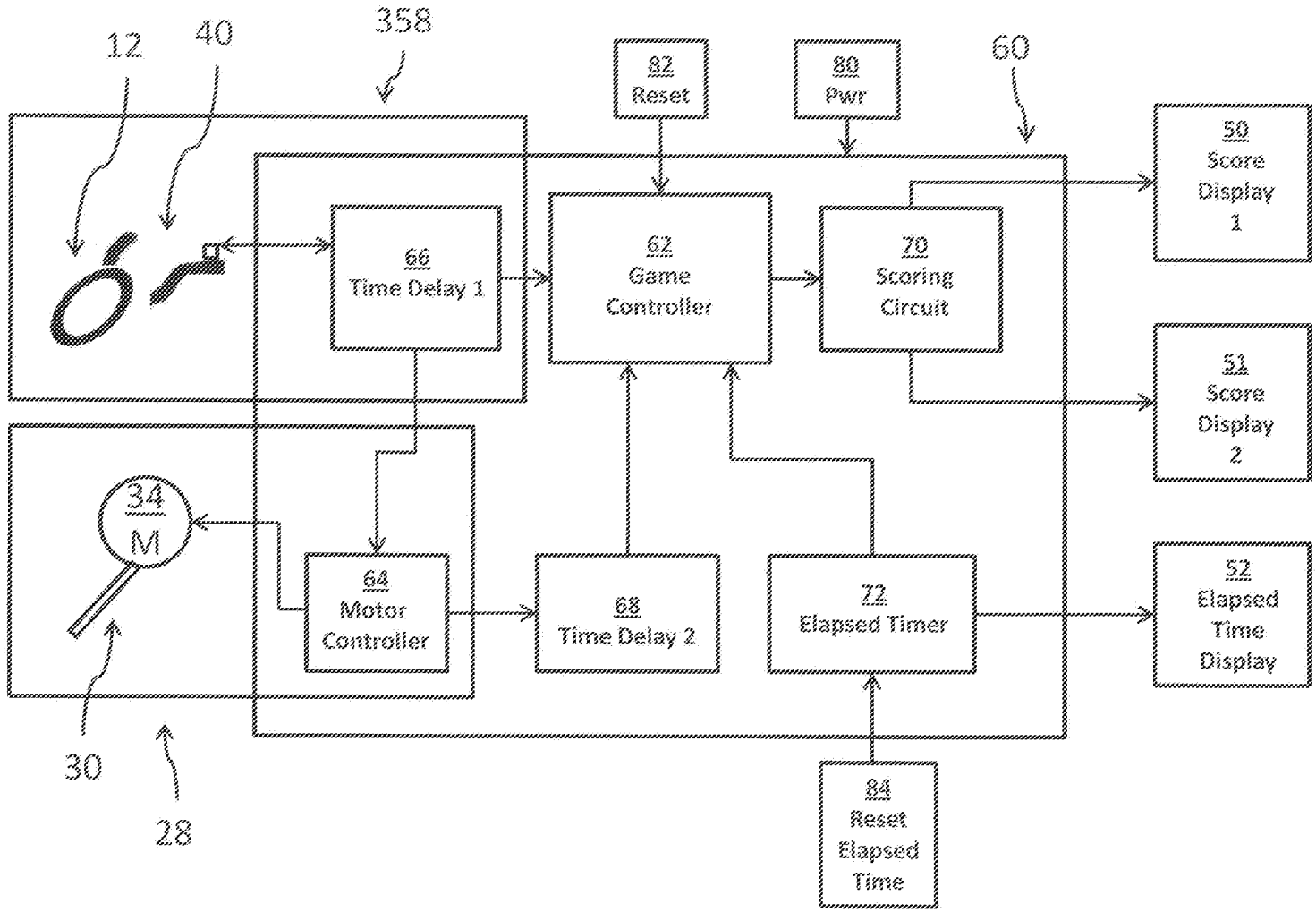
FIG. 8 is a block diagram of electronic game control system according to another preferred embodiment of the present invention.

Turning now to FIG. 8, a fourth preferred embodiment of the device while providing a control signal is illustrated at 358, and according to this embodiment, the hook 40 and ring 12 act as a stepped resistor. The hook 40 is wired into the first time delay circuit 66 and appears to the circuit as a first resistance. When the ring 12 is operatively captured by the hook 40, the resistance of the hook 40 and ring 12 combination is changed from that of the hook 40 alone. The change in resistance is seen by the first time delay circuit 66 as a change in voltage drop across the hook 40 and, if the change in resistance lasts long enough, the control signal CS is generated, the ring removal apparatus 28 is activated and the scoring circuit 70 tallies a score as hereinbefore described.

Use of the present invention can be illustrated by the following four examples, which also illustrate various modes of operation or game scenarios.

Figure 5:
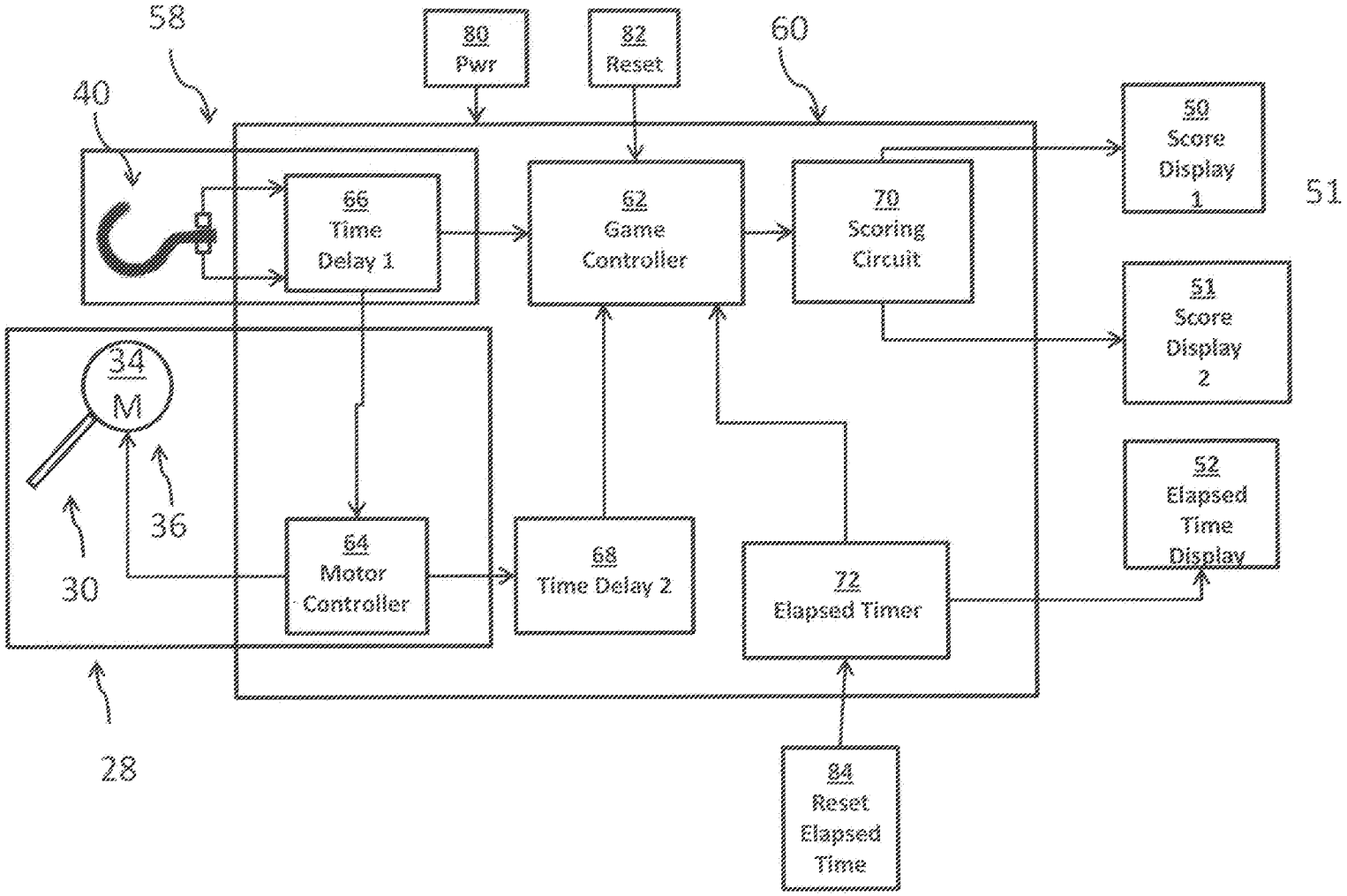
FIG. 5 is a block diagram of an electronic game control system according to one preferred embodiment of the present invention.

Example 1. The objective is to score as many points as you can in thirty seconds. With reference to FIG. 5, once the ring 12 is on the hook 40 and an operative capture has been established by the first time delay 66, the control signal CS is sent to the game controller 62, which causes the scoring circuit 70 to tally a score, which is displayed on the face of the housing 22 using a score display 51, 52. The control signal CS is applied to the motor controller 64 that causes the ring remover apparatus 28 to engage the ring 12 and remove the ring from the hook 40. Once the motor controller 64 has completed its task, the second time delay 68 signals the game controller 62 that further scoring may occur. All the while, the elapsed timer 72 is counting down thirty seconds, which is displayed on the elapsed time display 52. The points are tallied and the first player to twenty-one wins. If both players reach 21 in the same round, highest score wins. In the case of a tie, a tiebreaker round may be played. Accordingly, a player can stand in position and engage in game-play as the scoring accuracy is assured, and the ring is automatically returned to the player.

Example 2: The objective is to score three points as quickly as possible. Each player's time to three points is accumulated and the first player to reach a predetermined total time, for example 151 seconds, is deemed the loser. If the elapsed timer 72 reaches forty-five seconds before three points are scored, the player receives the forty-five seconds and a penalty five seconds, for a total of fifty seconds for that round.

Example 3: The objective is to score as many points as possible in ninety seconds. This mode is often used for single or double-elimination tournaments.

Example 4: Practice mode. There is no time limit in this mode, so the elapsed timer 72 is not used in practice mode. Use this mode to hone your throwing skills.

It is also contemplated that the present invention can be fitted with a wireless communication system, such as Wi-Fi, for remote communication of scores, game results and the like, via cell phones and the internet. Further, the Wi-Fi system may be operatively associated with the game controller for remote resets and the like, which may also be controlled via cell phone and the internet.

It will therefore be readily understood by those persons skilled in the art that the present invention is susceptible of a broad utility and application. While the present invention is described in all currently foreseeable embodiments, there may be other, unforeseeable embodiments and adaptations of the present invention, as well as variations, modifications and equivalent arrangements, that do not depart from the substance or scope of the present invention. The foregoing disclosure is not intended or to be construed to limit the present invention or otherwise to exclude such other embodiments, adaptations, variations, modifications and equivalent arrangements, the present invention being limited only by the claims appended hereto and the equivalents thereof.

We claim:

1. A ring toss game apparatus comprising:

a generally toroidal ring;

a line configured for suspending the ring from a support structure at a distal end of the line, for selective, manually induced pendulous movement of the ring through an arcuate path;

a housing configured for mounted disposition a predetermined length away from the ring support structure;

a hook mounted to the housing for operative capture of the ring through the hook opening;

means for providing a control signal responsive to the hook operatively capturing the ring; and means for engaging the ring and moving the ring off the hook in operational communication with the means for providing a control signal, the means for engaging the ring and moving the ring off the hook being operable responsive to the control signal to engage the ring and move the ring off the hook;

wherein games may be played by manually inducing pendulous movement of the ring toward the hook with the objective of each iteration thereof being operative engagement of the ring with the hook, resulting in a control signal being generated and applied to the means for engaging the ring and moving the ring off the hook, to engage the ring and move the ring off the hook, thereby allowing the ring to move under gravity and swing back to a player, thereby allowing another attempt at hook engagement without the player having to approach the hook and manually remove the ring.

2. A ring toss game apparatus according to claim 1 wherein the means for providing a control signal includes an electrical circuit having a normally-open switch operatively associated with the hook, wherein the switch is closed upon operative capture of the ring by the hook, the means for providing a control signal being in operative communication with the means for engaging the ring and moving the ring off the hook, wherein closing the switch initiates the control signal, thereby activating the means for engaging the ring and moving the ring off the hook.

3. A ring toss game apparatus according to claim 2 wherein the hook includes a first conductive element, a second conductive element, and an insulator therebetween extending a predetermined distance through the long axis of the hook, thereby defining two conductors separated by an insulator through the length of the hook, wherein the first conductive element and the second conductive element are operatively connected to the means for providing a control signal, and wherein the ring is formed from an electrically conductive material, whereby the hook and the ring form the normally-open switch which is closed by operative capture of the ring by the hook, thereby causing the ring to electrically connect the first conductive element and the second conductive element, thereby closing the switch and initiating the control signal, thereby activating the means for engaging the ring and moving the ring off the hook.

4. A ring toss game apparatus according to claim 2 wherein both the ring and the hook are in electrical communication with the means for providing a control signal, wherein the hook and ring form a switch that is closed upon operative capture of the ring by the hook, wherein closing the switch initiates the control signal, thereby activating the means for engaging the ring and moving the ring off the hook.

5. A ring toss game apparatus according to claim 1 wherein the means for providing a control signal includes an electrical circuit having an optical switch operatively associated with the hook, wherein the switch is closed upon operative capture of the ring by the hook, the control circuit being in operative communication with the means for engaging the ring and moving the ring off the hook, wherein closing the switch initiates the control signal, thereby activating the means for engaging the ring and moving the ring off the hook.

6. A ring toss game apparatus according to claim 1 wherein the means for providing a control signal includes an electrical circuit having the hook in the circuit as a resistive element with a first predetermined resistance, wherein the operative capture of the hook results in the hook and ring forming the resistive element with a second predetermined resistance, and a voltage detector to detect the change in voltage drop across the resistive element caused by operative capture of the ring by the hook, the means for providing a control signal being in operative communication with the means for engaging the ring and moving the ring off the hook, wherein a predetermined change in voltage drop across the resistive element initiates the control signal, thereby activating the means for engaging the ring and moving the ring off the hook.

7. A ring toss game apparatus according to claim 1 wherein the means for engaging the ring and moving the ring off the hook includes a movable arm mounted to the housing adjacent the hook for ring-removal movement through a predetermined path to selectively engage the ring and move the ring off the hook.

8. A ring toss game apparatus according to claim 7 wherein the means for engaging the ring and moving the ring off the hook includes a motor operatively associated with the arm for driving the arm through the predetermined path to selectively engage the ring and move the ring off the hook, and a motor control circuit for controlling motor operation.

9. A ring toss game apparatus according to claim 8 wherein the motor is a servo motor configured to drive the arm between a vertically downwardly extending disposition and a generally upwardly extending position along the predetermined path upon activation by the motor control circuit signal to selectively engage the ring and move the ring off the hook.

10. A ring toss game apparatus according to claim 8 and wherein the means for providing a control signal includes a time delay circuit in operative communication with the motor control circuit to delay activation of the means for engaging the ring and moving the ring off the hook for a predetermined duration after the ring contacts the hook, thereby establishing an operative capture of the ring.

11. A ring toss game apparatus according to claim 8 wherein the means for providing a control signal includes a time delay circuit configured to delay application of the control signal for a predetermined time after each operative ring capture to allow the ring to swing back to a user.

12. A ring toss game apparatus according to claim 8 and further comprising a scoring circuit including a preprogrammed microcomputer having at least one counter circuit configured to count the number of operative ring captures, and a display element operatively associated with the counter element to display a numerical score.

13. A ring toss game apparatus according to claim 1 and further comprising an elapsed time calculator selectively operable in association with the means for providing a control signal for timed game activities and a display element mounted to the housing for displaying numerical time data.

14. A ring toss game apparatus comprising:

a generally toroidal ring;

a line configured for suspending the ring from a support structure at a distal end of the line, for selective, manually induced pendulous movement of the ring through an arcuate path;

a housing configured for mounted disposition a predetermined length away from the ring support structure;

a hook mounted to the housing for operative capture of the ring through the hook opening;

a device for providing a control signal responsive to the hook operatively capturing the ring including an electrical circuit having a switch operatively associated with the hook, wherein the switch is closed upon operative capture of the ring by the hook; and means for engaging the ring and moving the ring off the hook in operational communication with the device for providing a control signal, the means for engaging the ring and moving the ring off the hook being operable responsive to the control signal to engage the ring and move the ring off the hook;

wherein games may be played by manually inducing pendulous movement of the ring toward the hook with the objective of each iteration thereof being operative engagement of the ring with the hook, resulting in a control signal being generated and applied to the means for engaging the ring and moving the ring off the hook, to engage the ring and move the ring off the hook, thereby allowing the ring to move under gravity and swing back to a player, thereby allowing another attempt at hook engagement without the player having to approach the hook and manually remove the ring.

15. A ring toss game apparatus according to claim 14 wherein the hook includes a first conductive element, a second conductive element, and an insulator therebetween extending a predetermined distance through the long axis of the hook, thereby defining two conductors separated by an insulator through the length of the hook, wherein the first conductive element and the second conductive element are operatively connected to the device for providing a control signal, and wherein the ring is formed from an electrically conductive material, whereby the hook and the ring form the normally-open switch which is closed by operative capture of the ring by the hook, thereby causing the ring to electrically connect the first conductive element and the second conductive element, thereby closing the switch and initiating the control signal.

16. A ring toss game apparatus according to claim 15 wherein both the ring and the hook are in electrical communication the device for providing a control signal, wherein the hook and ring form a switch that is closed upon operative capture of the ring by the hook, wherein closing the switch activates the means for engaging the ring and moving the ring off the hook.

17. A ring toss game apparatus according to claim 14 wherein the device for providing a control signal includes an electrical circuit having an optical switch operatively associated with the hook, wherein the switch is closed upon operative capture of the ring by the hook, the device for providing a control signal being in operative communication with the means for engaging the ring and moving the ring off the hook, wherein closing the switch activates the means for engaging the ring and moving the ring off the hook.

18. A ring toss game apparatus according to claim 14 wherein the device for providing a control signal includes an electrical circuit having the hook in the circuit as a resistive element with a first predetermined resistance, wherein the operative capture of the hook results in the hook and ring forming the resistive element with a second predetermined resistance, and a voltage detector to detect the change in voltage drop across the resistive element caused by operative capture of the ring by the hook, the device for providing a control signal being in operative communication with the means for engaging the ring and moving the ring off the hook, wherein a predetermined change in voltage drop across the resistive element acts as a switch to activate the means for engaging the ring and moving the ring off the hook.

19. A ring toss game apparatus according to claim 14 wherein the means for engaging the ring and moving the ring off the hook includes a movable arm mounted to the housing adjacent the hook for ring-removal movement through a predetermined path to selectively engage the ring and move the ring off the hook, a servo motor operatively associated with the arm for driving the arm through the predetermined path to selectively engage the ring and move the ring off the hook, and a motor control circuit for controlling motor operation.

20. A ring toss game apparatus comprising:

a generally toroidal ring;

a line configured for suspending the ring from a support structure at a distal end of the line, for selective, manually induced pendulous movement of the ring through an arcuate path;

a housing configured for mounted disposition a predetermined length away from the ring support structure;

a hook mounted to the housing for operative capture of the ring through the hook opening;

a device for providing a control signal responsive to the hook operatively capturing the ring including an electrical circuit having a switch operatively associated with the hook, wherein the switch is closed upon operative capture of the ring by the hook, and an apparatus for engaging the ring and moving the ring off the hook in operational communication with the means for providing a control signal, the apparatus for engaging the ring and moving the ring off the hook being operable responsive to the control signal to engage the ring and move the ring off the hook and including a movable arm mounted to the housing adjacent the hook for ring-removal movement through a predetermined path to selectively engage the ring and move the ring off the hook, a motor operatively associated with the arm for driving the arm through the predetermined path to selectively engage the ring and move the ring off the hook and a motor control circuit for controlling motor operation responsive to the device for providing a control signal;

wherein games may be played by manually inducing pendulous movement of the ring toward the hook with the objective of each iteration thereof being operative engagement of the ring with the hook, resulting in a control signal being generated and applied to the apparatus for engaging the ring and moving the ring off the hook, to engage the ring and move the ring off the hook, thereby allowing the ring to move under gravity and swing back to a player, thereby allowing another attempt at hook engagement without the player having to approach the hook and manually remove the ring.

* * * * *